US005238244A

United States Patent [19]

Cotter et al.

[11] Patent Number: 5,238,244

[45] Date of Patent: Aug. 24, 1993

[54] PUMP BALL

[75] Inventors: James E. Cotter, Ashland, Ohio; John S. Weiss, New York, N.Y.

[73] Assignee: Weiss Twice Toys, Inc., New York, N.Y.

[21] Appl. No.: 854,497

[22] Filed: Mar. 20, 1992

Related U.S. Application Data

[63] Continuation-in-part of Ser. No. 695,736, May 6, 1991, Pat. No. 5,098,095.

[51] Int. Cl.[5] ..... A63B 37/00

[52] U.S. Cl. ..... 273/58 B; 446/220; 417/479

[58] Field of Search ..... 273/58 B, 58 R, 58 BA, 273/58 C, 65 R; 446/220, 224; 417/478, 479, 480

[56] References Cited

U.S. PATENT DOCUMENTS

| | | | |
|---|---|---|---|
| 1,814,055 | 7/1931 | Napier | 446/220 X |
| 2,698,028 | 12/1954 | Lee et al. | 446/224 X |
| 2,701,672 | 2/1955 | Glasco | 417/479 X |
| 3,133,696 | 5/1964 | Mirando | 417/479 |
| 5,098,095 | 3/1992 | Weiss | 446/220 X |

*Primary Examiner*—Mickey Yu

*Attorney, Agent, or Firm*—Bryan, Levitin, Franzino & Rosenberg

[57] ABSTRACT

An inflatable throw toy having a flexible wall defining an enclosure adapted to be thrown when inflated. A manually operated pump is fixed to the flexible wall. The pump includes a flexible resilient pump wall defining a closed pump chamber. The pump wall includes an actuator surface having an inlet hole therethrough, the inlet hole communicating with the closed pump chamber. The actuator surface is exposed to an exterior of the flexible wall and is surrounded by the flexible wall. The pump includes a one-way outlet valve in the pump wall at a location spaced from the inlet hole and communicating with an interior of the enclosure whereby pressing the actuator surface while covering the inlet hole causes the pumping chamber to contract, discharging air from the pumping chamber through the one way valve into the flexible wall for inflating the toy.

8 Claims, 1 Drawing Sheet

PUMP BALL

CROSS REFERENCE TO RELATED APPLICATION

This is a continuation-in-part of Ser. No. 07/695,736, filed May 6, 1991, entitled PUMP BALL, now U.S. Pat. No. 5,098,095.

FIELD AND BACKGROUND OF THE INVENTION

The present invention relates in general to inflated throwing toys, and in particular to a new and useful throwing toy which incorporates a pump.

A ball is known from U.S. Pat. No. 1,683,910 which contains a pumping mechanism for making a sound. The pumping mechanism is incorporated in this ball and reacts to pressure on a string connected between the hand of a person playing with the ball, and the ball itself. U.S. Pat. No. 3,119,617 discloses another self inflating ball which incorporates a pumping mechanism that reacts when the ball is struck against the ground to keep the ball inflated as it is bounced. The pumping mechanism in this patent extends from one end of the ball to the other and represents a large heavy internal structure which would effect the trajectory of the ball when the ball is thrown.

A self inflating cushion containing a pumping mechanism is disclosed in U.S. Pat. No. 2,698,028. An inflatable mattress containing a pump is disclosed in U.S. Pat. No. 2,068,134. An inflatable chair with a pump incorporated therein is disclosed in U.S. Pat. No. 2,437,602. A tire with inflating mechanism is also disclosed in U.S. Pat. No. 643,017.

A throwing toy which has an internal pumping mechanism and which minimally effects the throwing characteristics of the toy would represent an advancement in this field.

SUMMARY OF THE INVENTION

An object of the present invention is to provide a ball which includes an internal pumping mechanism which can be manipulated by a person to initially inflate the throwing toy in preparation for use. The internal pumping mechanisms of the present invention is balanced and relatively light to minimize its effect on the throwing characteristics of the toy. The mechanism is also robust to resist damage when the ball is bounced.

Accordingly, an object of the present invention is to provide an inflatable throw toy comprising: a flexible wall defining an enclosure adapted to be thrown when inflated; and manually operated inflation means in said enclosure and having an actuator surrounded by the wall for inflating said enclosure when said actuator is pressed.

A still further object of the present invention is to position a deflation valve opposite from the inflation means in the ball to balance the weight of the inflation means to avoid erratic flight when the toy is thrown.

Although a preferred embodiment of the invention is a spherical ball, the throw toy may be oblong such as a football, flat or disc shaped like a bulbous throwing disc, or any other inflatable shape adapted for throwing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
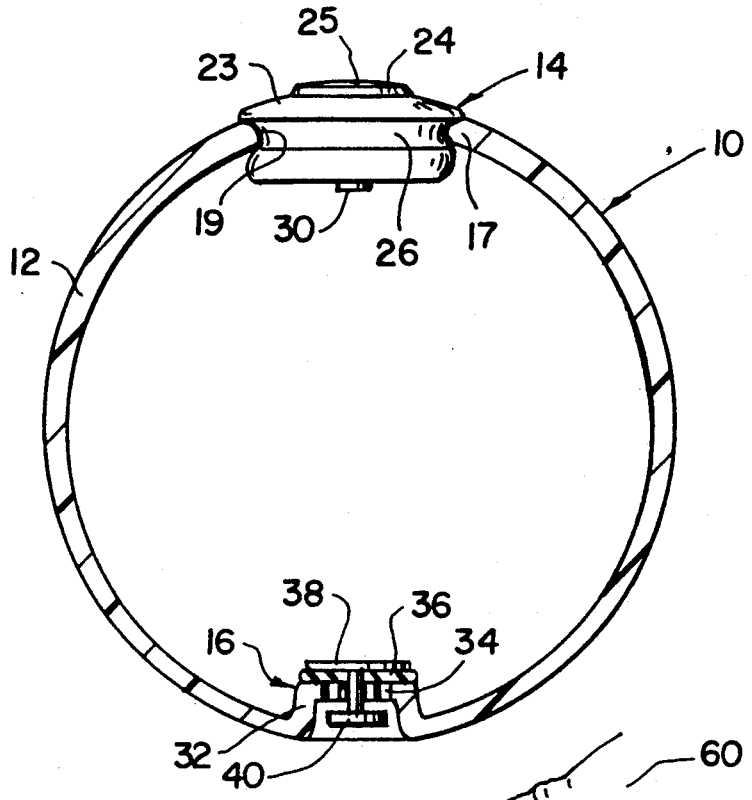
FIG. 1 is a sectional view of the throw toy in the form of a ball, in an inflated condition and according to one manner of connecting the pump to the throw toy.
Figure 2:
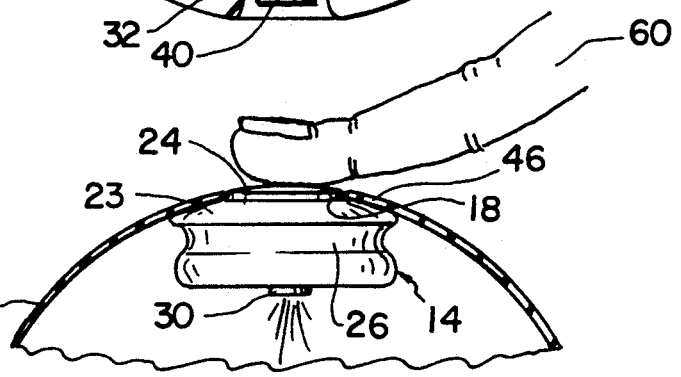
FIG. 2 is a partial sectional view of the invention showing another manner of connecting the pump.

Referring to the drawings in particular, the invention embodied in FIGS. 1 and 2 comprises an inflatable throw toy generally designated 10 and having a flexible wall 12 of plastic, rubber or other resilient synthetic material, which defines an enclosure which is hermetically sealed and adapted to be inflated so that the toy can be thrown. A manually operated inflation means 14 is mounted in the enclosure and on one side of the wall 12. Inflation means 14 has an outer actuator surface 23 which is rounded like the outer surface of the wall 12 so that it does not adversely effect the use of the ball when the ball is inflated for use. Dome-shaped actuator 23 which in the embodiment of FIG. 2 forms part of the spherical outer surface of the spherical ball forming the throw toy 10, is mounted by having an annular part 46 of the wall 12 around a hole 18, sealed, fused or glued to the actuator 23 around a projection 24 at its center. Projection 24 rises above the rest of actuator surface 23 so that it is flush with the outer surface of the ball. Actuator 23 also has a curvature that matches that of the spherical ball as shown in FIG. 2.

When actuator 23 is depressed by a finger 60 that covers and closes a hole 25 in the center of actuator 23, (see FIG. 3) air is pumped through a one way duck bill valve 30 into the ball 10. Finger 60 is then raised to open hole 25 and by the resiliency of the rubber-like material of pump 14, actuator 23 rises to re-inflate the interior chamber of the pump 14 for the next actuation.

In order to release the air from inside flexible wall 12, deflation means 16 having a release valve member 40 is actuated. Deflation means 16 comprises a somewhat rigid cylindrical support 32 made as one piece with or as a separate piece from the flexible wall 12 but hermetically sealed to the flexible wall. A flat inner wall of cylindrical support 32 carries a plurality of circumferentially disposed release holes 34 which, in the closed position for deflation means 16, are covered by a resilient closing disk 36. Release valve member 40 which may be made of rigid synthetic material, has a rear support disk 38 which, due to the internal pressure in valve 12, presses closing disk 36 against the base of cylindrical support 32 thus sealing the release holes 34. A spring (not shown) may also be used to keep deflation means 16 closed.

In the embodiment of FIG. 1, the inflation means or pump 14 is connected to wall 12 by capturing an annular portion 17 of the wall 12 around a hole 19 in the wall, in an annular groove 26 formed around the pump 14 below the actuator surface 23. To ensure that the enclosure of wall 12 is hermetically sealed, annular portion 17 of wall 12 is glued, fused, sealed or otherwise closely engaged to the pump 14, in groove 26.

Figure 3:
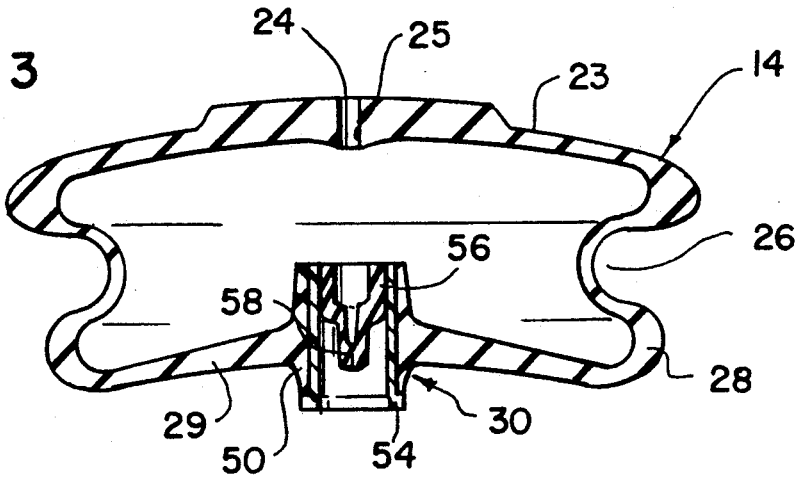
FIG. 3 is an enlarged sectional view of the pump alone.

As shown in FIG. 3, pump 14 comprises a one piece resilient member made of rubber or rubber-like material which retains its shape after being squeezed. Groove 26 is defined between the dome-shaped actuator surface 23 and a lower annular ring 28 which is slightly smaller in maximum diameter than the actuator 23. The outer peripheries of the actuator 23 and annular ring 28 have enlarged wall thicknesses to make them more rigid than the material of the groove 26, thus producing a bellows type effect.

The lower surface 29 of pump 14 is slightly concave upwardly and carries a cylindrical valve support 50 in which the duck bill valve 30 is mounted. Valve 30 comprises a rigid plastic cylindrical member having an enlarged lower end 54 that seats against the lower cylindrical edge of support 50. A resilient rubber duck bill member 56 is press-fit into the more rigid valve member and includes a lower duck bill projection 58 having a downwardly facing slit which opens when air moves from the inside of pump 14 downwardly through the valve into the interior of ball 10 and which closes and prevent reverse flow of air. Thus re-inflation of the pump 14 is entirely through the opening 25, after the actuating finger has been removed.

Projection 24 is also made of thicker walled material then the rest of actuator 23 so as to produce a button like effect when pressed.

While a specific embodiment of the invention has been shown and described in detail to illustrate the application of the principles of the invention, it will be understood that the invention may be embodied otherwise without departing from such principles.

What is claimed is:

1. An inflatable throw toy comprising:

a flexible wall defining an enclosure adapted to be thrown when inflated, said flexible wall including an opening therein; and a manually operated pump fixed to the flexible wall, said pump comprising a flexible resilient pump wall defining a closed pump chamber, said pump wall including an outwardly dome-shaped actuator surface having an open valve-less inlet hole therethrough, said inlet hole communicating with said closed pump chamber, said actuator surface being exposed to an exterior of the flexible wall and being surrounded by the flexible wall, said pump including a one-way outlet valve in said pump wall at a location opposite from said inlet hole and communicating with an interior of said enclosure whereby pressing said actuator surface while covering said inlet hole causes said pump chamber to contract, discharging air from said pump chamber through said one way valve into said flexible wall for inflating said flexible wall, said pump wall including a wall portion opposite from said actuator surface and a groove around said pump wall between said actuator surface and said opposite wall portion, said one-way valve being in said opposite wall portion and said opening in said flexible wall being sealed around said pump wall in said groove.

2. A throw toy according to claim 1, wherein said pump wall includes thick wall portions adjacent outer peripheries of each of said actuator surface and said opposite wall portion, and on opposite sides of said groove, said groove having a thinner wall thickness.

3. A throw toy according to claim 2, wherein said opposite wall portion is concave in a direction into said pump chamber.

4. A throw toy according to claim 1, wherein said dome-shaped actuator surface includes a raised central portion through which said inlet hole extends, said raised central portion having a thicker wall thickness than a remainder of said actuator surface.

5. A throw toy according to claim 4, wherein said one-way valve comprises a resilient duck bill valve.

6. A throw toy according to claim 1, wherein said actuator surface includes a raised central projection having a thicker wall thickness than a remainder of said actuator surface.

7. A throw toy according to claim 6, wherein said pump wall includes thick wall portions adjacent outer peripheries of each of said actuator surface and said opposite wall portion, and on opposite sides of said groove, said groove having a thinner wall thickness.

8. A throw toy according to claim 7, wherein said one-way valve comprises a resilient duck bill valve.

* * * * *